US010711469B2

(12) United States Patent
Brown

(10) Patent No.: US 10,711,469 B2
(45) Date of Patent: Jul. 14, 2020

(54) INTERLOCKING AND SHOCK ATTENUATING TILING SYSTEMS

(71) Applicant: Combitile Pty Ltd, Fortitude Valley (AU)

(72) Inventor: Graham Kevin Brown, Wamberal (AU)

(73) Assignee: COMBITILE PTY LTD, Long Jetty, NSW (AU)

( * ) Notice: Subject to any disclaimer, the term of this patent is extended or adjusted under 35 U.S.C. 154(b) by 0 days.

(21) Appl. No.: 15/880,146

(22) Filed: Jan. 25, 2018

(65) Prior Publication Data

US 2018/0148937 A1 May 31, 2018

Related U.S. Application Data

(62) Division of application No. 14/784,174, filed as application No. PCT/AU2014/000424 on Apr. 14, 2014, now abandoned.

(30) Foreign Application Priority Data

Apr. 14, 2013 (AU) ..... 2013901289
Nov. 18, 2013 (AU) ..... 2013904456

(51) Int. Cl.
*E04F 15/22* (2006.01)
*E04F 15/10* (2006.01)
(Continued)

(52) U.S. Cl.
CPC ..... *E04F 15/225* (2013.01); *E01C 13/045* (2013.01); *E04F 15/02183* (2013.01);
(Continued)

(58) Field of Classification Search
CPC ... E04F 15/225; E04F 15/02183; E04F 15/10; E04F 13/045; E04F 2203/02;
(Continued)

(56) References Cited

U.S. PATENT DOCUMENTS 1,828,193 A * 10/1931 Levin ..... E04F 15/10 52/388
4,267,681 A 5/1981 Dickson
(Continued)

FOREIGN PATENT DOCUMENTS

FR 2498666 A1 * 7/1982 ..... E04F 15/10
GB 2414711 A 7/2005
(Continued)

OTHER PUBLICATIONS

Machine translation of foreign reference FR 2498666, obtained from http://translationportal.epo.org/emtp/translate/?ACTION=description-retrieval&COUNTRY=FR&ENGINE=google&FORMAT=docdb&KIND=A1&LOCALE=en_EP&NUMBER=2498666&OPS=ops.epo.org/3.2&SRCLANG=fr&TRGLANG=en (last accessed on Feb. 26, 2019) (Year: 2019).*
(Continued)

*Primary Examiner* — Theodore V Adamos
(74) *Attorney, Agent, or Firm* — Sorell, Lenna & Schmidt, LLP

(57) ABSTRACT

An interlocking floor tile assembly is provided. It includes a first repeating array of spaced apart first tiles interconnected by first bridge portions wherein the first tiles and the first bridge portions define first spaces therebetween. It also includes a second repeating array of spaced apart second tiles interconnected by second bridge portions wherein the second tiles and the second bridge portions define second spaces therebetween. The second tiles are received in the first spaces and the first tiles are received in the second spaces. A shock attenuating tile may be provided in conjunction with the interlocking floor tile assembly to form a ground covering that is suitable for fall risk areas such as playgrounds. The shock attenuating tile preferably includes a plate having an upper side for bearing a load and a plurality
(Continued)

of shock absorbing modules depending from an underside of the plate.

12 Claims, 12 Drawing Sheets

(51) Int. Cl.
*E04F 15/02* (2006.01)
*E01C 13/04* (2006.01)

(52) U.S. Cl.
CPC ..... *E04F 15/10* (2013.01); *E01C 2201/10* (2013.01); *E04F 15/22* (2013.01)

(58) Field of Classification Search
CPC ..... E04F 2203/04; E04F 2203/06; E04F 2203/065; E04F 15/22; E01C 13/045; E01C 5/20; E01C 13/083; E01C 2201/10; E02B 11/00; Y10T 428/24661
USPC ..... 52/403.1, 177, 180
See application file for complete search history.

(56) References Cited

U.S. PATENT DOCUMENTS 4,535,553 A * 8/1985 Derderian ..... A43B 13/181 36/28
4,998,717 A * 3/1991 Vaux ..... E01C 5/18 404/32
5,532,039 A * 7/1996 Payne ..... B32B 3/12 428/116
5,619,832 A * 4/1997 Myrvold ..... E02D 31/02 428/116
5,950,378 A * 9/1999 Council ..... E01C 13/045 52/177
6,029,962 A * 2/2000 Shorten ..... A43B 13/181 267/145
7,162,839 B2 * 1/2007 Ohno ..... B21D 22/04 428/597
7,571,573 B2 * 8/2009 Moller, Jr. ..... E01C 5/20 472/92
7,900,416 B1 * 3/2011 Yokubison ..... E04F 15/10 52/177
8,225,566 B2 * 7/2012 Prevost ..... E01C 13/08 52/177
D685,924 S * 7/2013 Lee ..... D25/118
8,528,286 B2 * 9/2013 Keene ..... B32B 5/12 52/145
8,955,278 B1 * 2/2015 Mills ..... E04B 5/48 52/302.3
2002/0124506 A1 * 9/2002 Mercade ..... A47L 23/24 52/390
2004/0118059 A1 * 6/2004 Ohno ..... B21D 28/10 52/177
2005/0034395 A1 * 2/2005 Kotler ..... E01C 5/20 52/384
2005/0193669 A1 9/2005 Jenkins et al.
2006/0144012 A1 * 7/2006 Manning ..... B32B 5/02 52/782.1
2007/0289244 A1 * 12/2007 Haney ..... E01C 5/20 52/539
2009/0049601 A1 * 2/2009 Shih ..... E03C 1/22 4/679
2010/0260546 A1 * 10/2010 Blackwood ..... E03F 1/002 405/36
2011/0097151 A1 * 4/2011 Lee ..... E01C 13/083 405/39
2011/0104434 A1 * 5/2011 Masanek, Jr. ..... E01C 5/226 428/137
2011/0247285 A1 * 10/2011 Wybo ..... B29C 48/908 52/309.1
2013/0071625 A1 * 3/2013 Masanek, Jr. ..... E04F 15/105 428/172
2013/0086861 A1 * 4/2013 Masanek, Jr. ..... E04C 2/20 52/309.1
2013/0263476 A1 * 10/2013 Santos ..... A43B 1/0081 36/130
2015/0075092 A1 * 3/2015 Moller, Jr. ..... E04F 15/225 52/177

FOREIGN PATENT DOCUMENTS

GB 2479390 A 10/2011
WO 9922160 A1 5/1999

OTHER PUBLICATIONS

Supplementary Partial European Search Report arid Written Opinion of the European Patent Office dated Mar. 21, 2017 of European Application No. EP 14 78 5784.1 filed Apr. 14, 2014.
Notification of First Office Action dated Oct. 21, 2016, issued by the People's Republic of China State Intellectual Property Office, of Chinese Application No. 201480021146.2 of Combitile Pty Ltd. for "Interlocking and Shock Attenuating Tiling Systems."
International Search Report of the International Searching Authority dated Jun. 25, 2014 of International Application No. PCT/AU2014/000424 filed Apr. 14, 2014.
Written Opinion of the International Preliminary Examining Authority dated May 27, 2015 of the International Application No. PCT/AU2014/000424 filed Apr. 14, 2014.

* cited by examiner

INTERLOCKING AND SHOCK ATTENUATING TILING SYSTEMS

TECHNICAL FIELD

The present invention relates to ground covering tiles that are made of resilient synthetic materials. Such tiles find use in many different environments. Particular embodiments of the present invention are suited for use in recreational areas such as playgrounds for children.

BACKGROUND

Any references to methods, apparatus or documents of the prior art are not to be taken as constituting any evidence or admission that they formed, or form part of the common general knowledge.

It has been known to provide rubber floor tiles which interlock at their edges to produce a tiled surface. Alternate floor tiles may have different colors or patterns in order to produce a checkerboard effect.

A number of problems are associated with these prior art interlocking tiling systems. One problem is that it is time consuming to interlock the edges of numerous tiles together. Effort and attention must be brought to bear to precisely locate each tile adjacent its neighbors and interlock the respective edges together. Furthermore, if a checkerboard, or other, pattern is to be created then care must be taken to alternate the differently colored tiles together. If care is not taken then it may become apparent after the tiles have been assembled together that two tiles of the same type have inadvertently been placed adjacent to each other so that the desired pattern is not created. In that case the tiles will have to be dissembled and reassembled so that the error is corrected.

A further problem with the edge interlocking tiling systems of the prior art is that the interlocking between adjacent tiles is sometimes not as good as might be desired so that after some use the tiles may tend to lift away from their neighbors at the edges or otherwise cause distortion of the flooring system.

Another problem with the rubber floor tiles of the prior art is that their shock attenuating properties may be insufficient for preventing injuries due to a person, e.g. a child, falling in some situations. It would be advantageous if a ground cover system were provided that had improved shock attenuating properties to reduce the likelihood of an injury due to a fall.

One approach to providing a resilient shock attenuating ground covering in fall areas, such as playgrounds for children, has been to provide rubber matting. Rubber matting may be comprised of shredded tire material for example. A problem that is associated with the use of this type of impact absorbing surface is that it may lose its structural integrity over time and fray so that the rubber shreds of which it is composed become dispersed.

It is an object of the invention to provide a tiling system which addresses one or more of the above described problems or which is at least a useful commercial alternative to those tiling systems that have hitherto been known.

SUMMARY OF THE INVENTION

According to a first aspect of the present invention there is provided an interlocking floor tile assembly comprising:

a first repeating array of spaced apart first tiles interconnected by first bridge portions wherein the first tiles and the first bridge portions define first spaces therebetween; and a second repeating array of spaced apart second tiles interconnected by second bridge portions wherein the second tiles and the second bridge portions define second spaces therebetween;

wherein the second tiles are received in the first spaces and the first tiles are received in the second spaces.

Preferably the first bridge portions depend (i.e. extend downwardly) from a level flush with an upper surface of the first tiles to a level between the top and bottom surface of the first tiles and wherein the second bridges extend upward from a level flush with the bottom surface of the second tiles to a level between the top and bottom surface of the second tiles.

The first and second spaced apart tiles and the first and second respective spaces therebetween are preferably all of the same shape.

In a preferred embodiment of the invention the first tiles and the second tiles bear respective complementary mating portions for mating of the first tiles with the second tiles.

The complementary mating portions preferably comprise complementarily chamfered or "drafted" edges in order that the first tiles and the second tiles snap-fit together.

The first tiles and the second tiles may be differently colored.

The first and second tiles may be of different visual appearances though substantially square shaped so that the assembly presents a checkerboard pattern.

According to a further embodiment of the present invention there is provided a shock attenuating ground covering including:

a plurality of interconnected shock attenuating tiles each said tile comprising a plate having an upper side for bearing a load and a plurality of shock absorbing modules integrally formed with and depending from an underside of the plate; and a cover supported by the upper surface of the interconnected shock attenuating tiles, the cover comprising a first repeating array of spaced apart first tiles interconnected by first bridge portions wherein the first tiles and the first bridge portions define first spaces therebetween and a second repeating array of spaced apart second tiles interconnected by second bridge portions wherein the second tiles and the second bridge portions define second spaces therebetween wherein the second tiles are received in the first spaces and the first tiles are received in the second spaces;

whereby the ground covering presents a weight bearing surface for traffic thereon and the interconnected shock attenuating tiles provide cushioning thereunder.

Preferably the first bridge portions depend from a level flush with an upper surface of the first tiles to a level between the top and bottom surface of the first tiles and wherein the second bridges extend upward from a level flush with the bottom surface of the second tiles to a level between the top and bottom surface of the second tiles.

In one embodiment the first and second spaced apart tiles and the first and second respective spaces therebetween are all of the same shape.

In a preferred embodiment of the invention the first tiles and the second tiles bear respective complementary mating portions for mating of the first tiles with the second tiles.

Preferably the complementary mating portions comprise complementarily chamfered or "drafted" edges in order that the first tiles and the second tiles snap-fit together.

The first tiles and the second tiles may be differently colored.

Preferably the first and second tiles are of different visual appearances and substantially square shaped so that the assembly presents a checkerboard pattern.

Each shock attenuating tile may be formed as a single piece of synthetic material.

It is preferred that each of the shock absorbing members extends from the underside about a corresponding aperture formed through the plate.

Preferably engagement formations are formed along outer edges of each of the shock attenuating tiles.

The engagement formations may include sockets formed along one edge of each of the shock attenuating tiles and complementary plugs formed along another edge of each of said tiles in order that the plurality of the tiles are interconnected.

The engagement formations may include a number of hooks formed along one edge of each of the tiles and a number of complementary engagement members disposed along an opposite edge of each of the tiles.

Preferably each of the shock absorbing modules comprises a plurality of resilient members depending downward from the underside with their remote ends joined.

The resilient members may comprise arcuate portions.

A vegetation resistant mesh may be interposed between the upperside of the shock attenuating tiles and the cover.

The mesh may be fastened to the shock attenuating tiles.

Tiles of the cover may be formed with apertures therethrough to allow for drainage.

According to another aspect of the present invention there is provided an interlocking floor tile assembly comprising a repeating array of spaced apart tiles interconnected by bridge portions, wherein spaces between the spaced apart tiles are arranged to receive complementary tiles therein.

Preferably edges of the spaced apart tiles bear engagement formations shaped to mate with complementary engagement formations of the complementary tiles.

In a preferred embodiment of the invention the complementary mating portions comprise complementarily chamfered or "drafted" edges in order that the first tiles and the second tiles snap fit together.

The spaced apart tiles and said spaces therebetween may be of the same shape.

Alternatively the spaced apart tiles and the spaces therebetween may be of different, though complementary, shapes.

Preferably the interlocking floor tile assembly is formed of a resilient synthetic material.

The resilient synthetic material may comprise polypropylene or another member of the polyolefin group of materials.

According to a further aspect of the present invention there is provided a shock attenuating tile comprising:

a plate having an upper side for bearing a load; and a plurality of shock absorbing modules depending from an underside of the plate, wherein each of the shock absorbing modules is integrally formed with the plate.

The shock attenuating tile is preferably formed as a single piece of synthetic material.

Each of the shock absorbing members may extend from the underside about a corresponding aperture formed through the plate.

Preferably engagement formations are formed along outer edges of the shock attenuating tile.

The engagement formations may include sockets formed along one edge of the shock attenuating tile and complementary plugs formed along another edge in order that a plurality of the tiles may be interconnected.

The engagement formations may include a number of hooks formed along one edge of the tile and a number of complementary engagement members disposed along an opposite edge of the tile.

Preferably each of the shock absorbing modules comprises a number of resilient members. For example, the shock absorbing module may comprise a plurality of resilient members depending downward from the underside with their remote ends joined.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
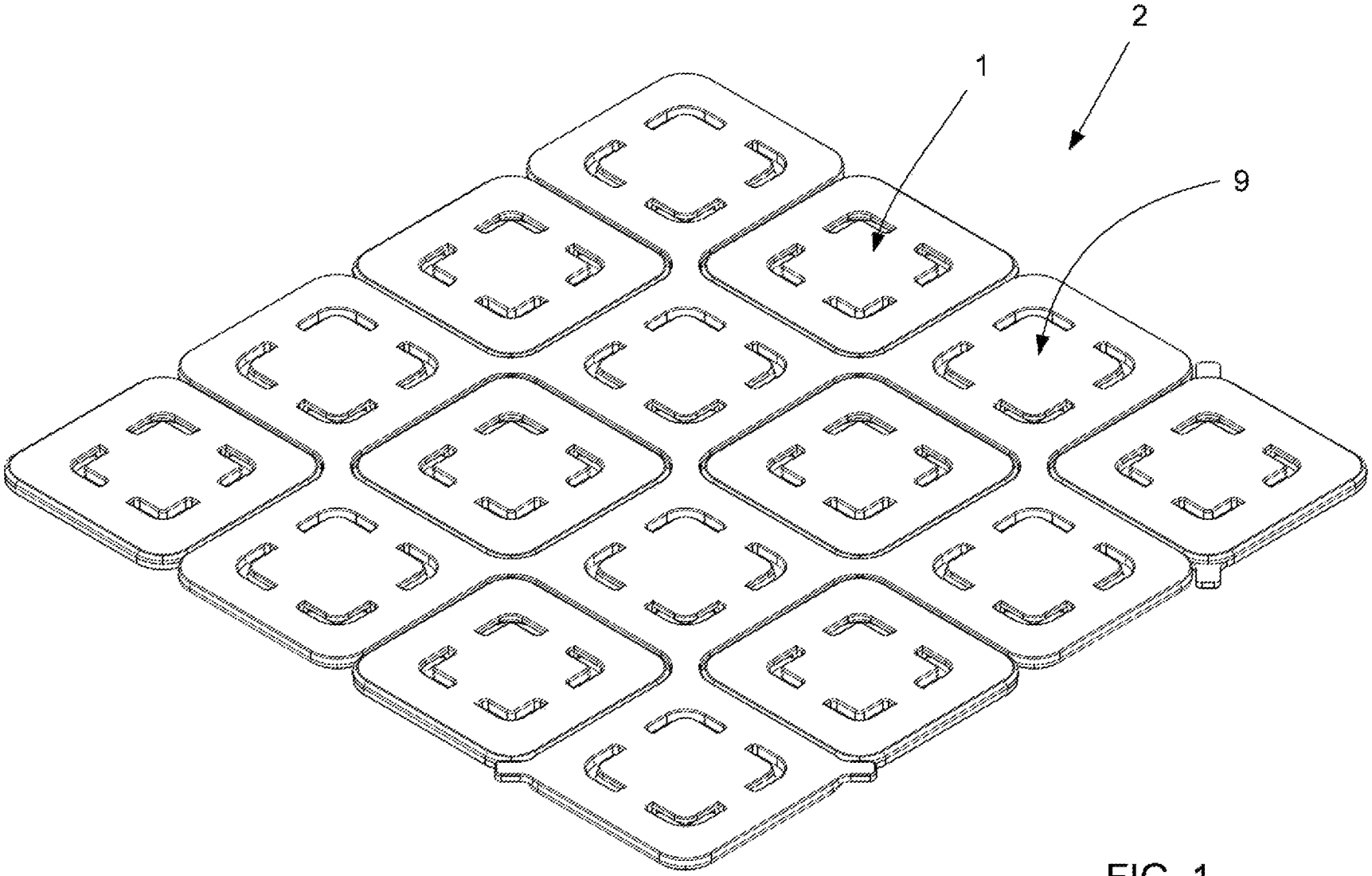
FIG. 1 depicts a tile assembly according to a preferred embodiment of a first aspect of the present invention.
Figure 2:
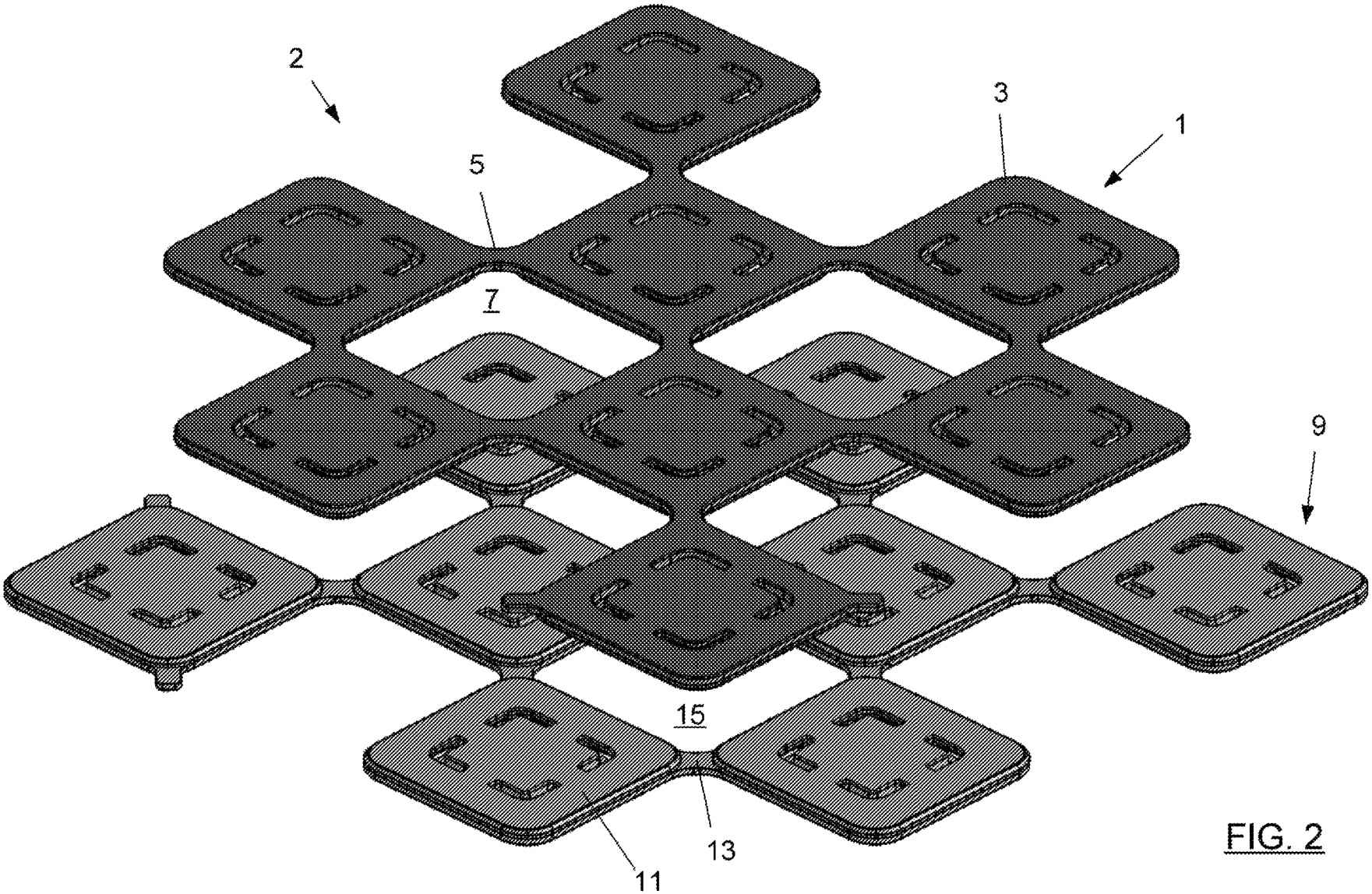
FIG. 2 is an exploded view of the tile assembly of FIG. 1.

FIG. 1 depicts an interlocking floor tile assembly 2 whereas FIG. 2 comprises an exploded view of the same assembly. With reference to FIG. 2, the interlocking floor tile assembly 2 comprises a first repeating array 1 of spaced apart first tiles 3 interconnected by first bridge portions 5. The first tiles 3 and the first bridge portions 5 define first spaces 7 therebetween. The interlocking floor tile assembly 2 further comprises a second repeating array 9 of spaced apart second tiles 11 interconnected by second bridge portions 13 wherein the second tiles and the second bridge portions define second spaces 15 therebetween.

As shown in FIG. 1 the second tiles 11 are received in the first spaces 7 and the first tiles 3 are received in the second spaces 15.

In the embodiment depicted in FIGS. 1 and 2 the first and second tiles are of the same thickness. The first bridge portions 5 depend from being flush with an upper surface of the first tiles 3 to a level, e.g. halfway, between the top and bottom surface of the first tiles 3. In complementary fashion the second bridges 13 extend upward from flush with the bottom surface of the second tiles 11 to a level, e.g. halfway, between the top and bottom surface of the second tiles 13.

As shown in FIGS. 1 and 2, the first and second spaced apart tiles 3 and 11 and the first and second spaces 7 and 15 therebetween are all of the same shape. However, in other embodiments the shapes of the first tiles and the second tiles may be different although the second tiles and the second spaces remain complementary thereto, respectively.

The first tiles and the second tiles interlock by overlapping and snap fitting. Snap-fit joints rely on the ability of a resilient part to be deformed, within limits, and returned to its original shape when assembly is complete. As the engagement of the parts continues, an undercut relieves the interference. At full engagement, there is no stress on either half of the joint. The maximum interference during assembly should not exceed the proportional limit. After assembly, the load on the components should only be sufficient to maintain the engagement of the parts.

Figure 2A:
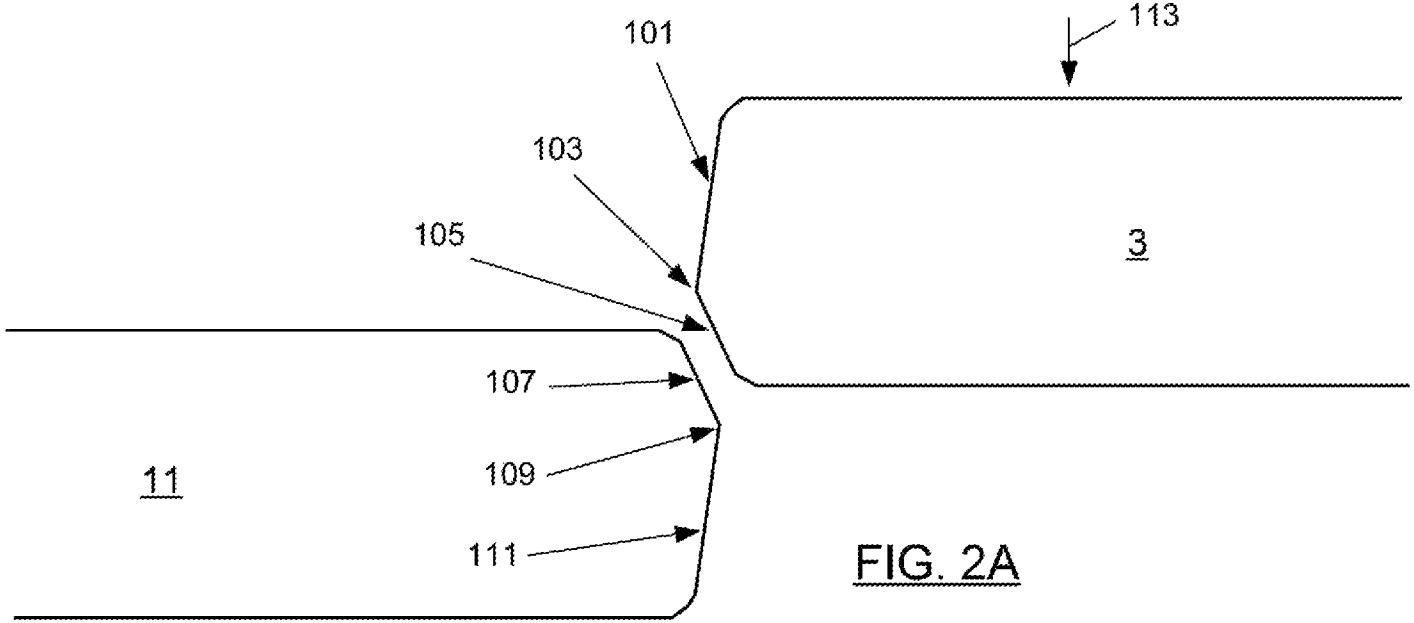
FIGS. 2A and 2B are progressive detail views illustrating the snap-fitting together of ends of tile portions of the tile assembly.
Figure 2B:
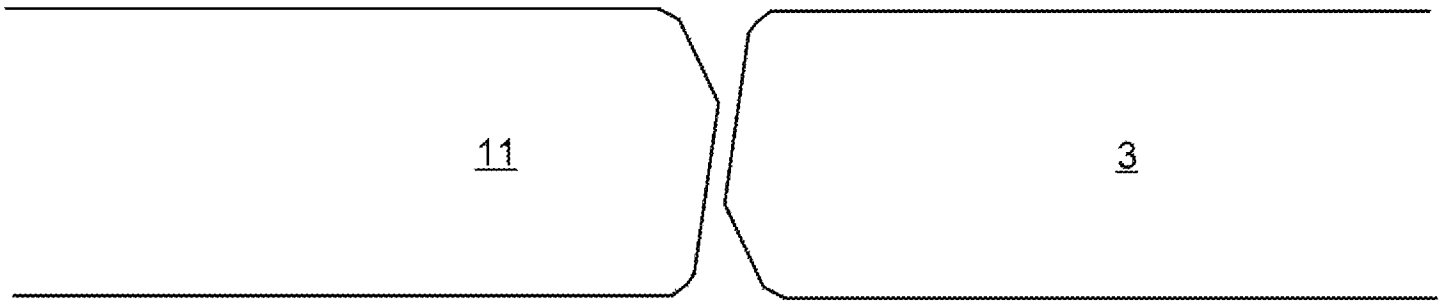

FIG. 2A, is a cross section of the adjacent edges of two tile portions 11 and 3 prior to them assuming the interlocked configuration shown in FIG. 1. The respective lead in angles 105, 107 of each tile portion 3, 11 are pressed against each other by a force 113 pressing down on tile portion 3. The force 113 would be applied by a person installing the tile assembly. Subsequently the snapping points 103, 109 of the edges of the two tile portions 3, 11 are forced against each other so that they momentarily deform sufficiently, to pass each other i.e. they "snap" past each so that they assume the interlocked configuration of FIG. 2B wherein their respective locking drafts 101, 111 are brought adjacent each other as shown (the space between the locking drafts 101, 111 that is visible in FIG. 2B is included to assist in understanding the snap fit. In actual use the space between the locking drafts would be very small or even nonexistent. Once in the configuration shown in FIG. 2B the tile portions 11 and 3 stay in place due to the interference between the complementary upper and lower locking drafts on the edges of the tile portions 3 and 11.

As shown in FIGS. 1 and 2, the first tile portions 3 and the second tile portions 11 may be differently colored. Where the first and second tiles are of different colors and are substantially square shaped the assembly will present a checkerboard pattern. Other patterns are also possible and different patterns may be produced on the surface of the tile assembly 2 by interchanging differently patterned tiles tile arrays 1 and 9.

Figure 2C:
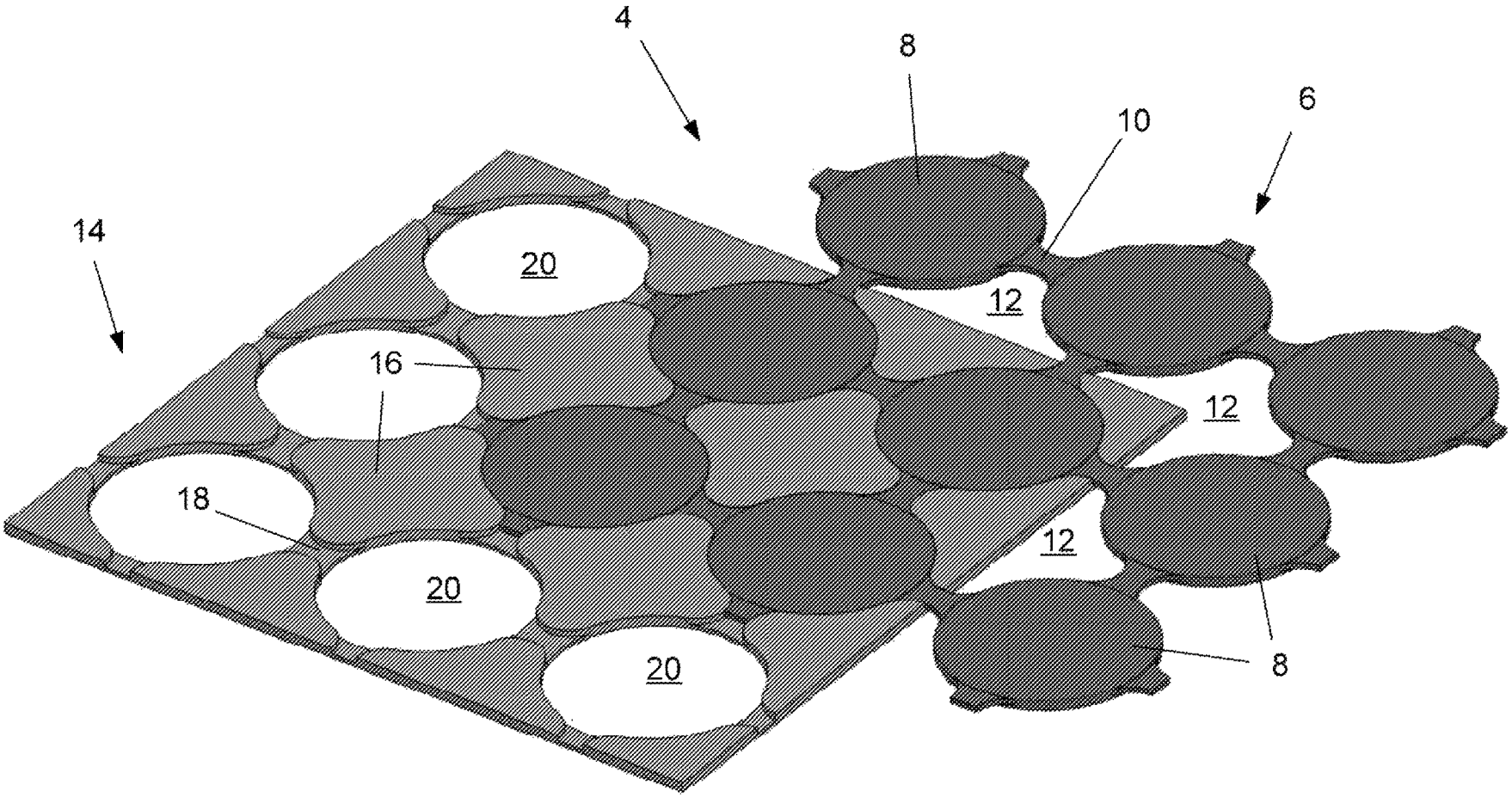
FIG. 2C depicts a further tile assembly according to another embodiment of the present invention.

For example FIG. 2C depicts an interlocking floor tile assembly 4 according to a further embodiment of the present invention which also uses the snap-fit edge profiles that have been described with reference to FIGS. 2A and 2B. The interlocking floor tile assembly 4 comprises a first repeating array 6 of spaced apart first tiles 8 interconnected by first bridge portions 10. The first tiles 8 and the first bridge portions 10 define first spaces 12 therebetween. The interlocking floor tile assembly 4 further comprises a second repeating array 14 of spaced apart second tiles 16 interconnected by second bridge portions 18 wherein the second tiles and the second bridge portions define second spaces 20 therebetween.

As shown in FIG. 1 the second tiles 11 are received in the first spaces 7 and the first tiles 3 are received in the second spaces 15.

It is preferred that the interlocking floor tile assembly is formed of a resilient synthetic material. For example, the assembly of FIGS. 1 and 2 comprises polypropylene. Other members of the polyolefin group of materials, or indeed other suitably hardwearing and resilient material, might also be used.

Figure 3:
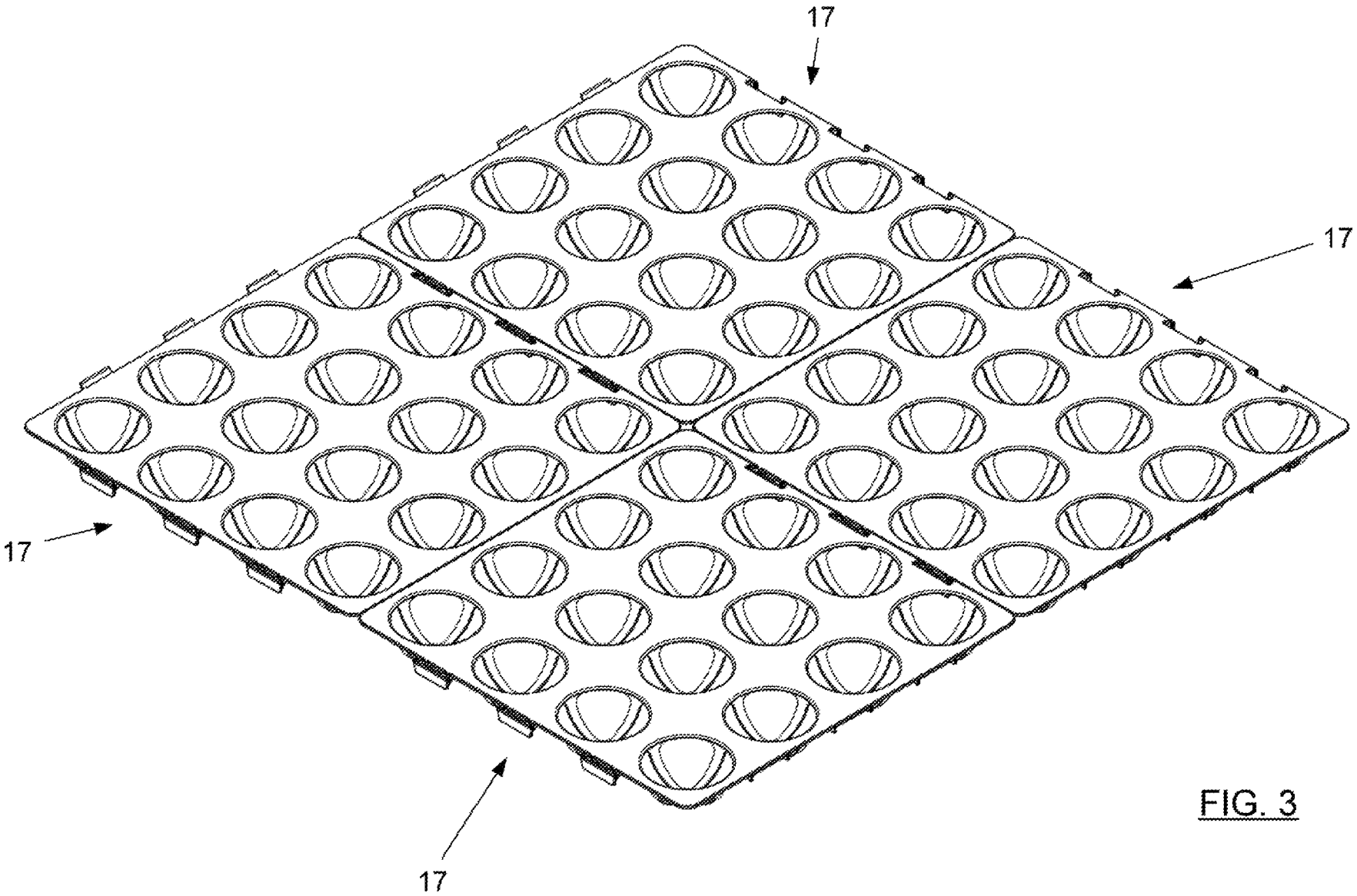
FIG. 3 depicts a number of shock attenuating tiles according to a preferred embodiment of a second aspect of the present invention.

FIG. 3 illustrates four interconnected shock attenuating tiles 17 according to a preferred embodiment of a further aspect of the present invention. Each of the tiles 17 is in accordance with a preferred embodiment of another aspect of the present invention. As will be discussed, the shock attenuating tiles can be used in conjunction with a cover, for example a cover comprising the previously described interlocking tile assemblies to form a shock absorbing ground cover that is suitable for use in crèches and playgrounds.

Figure 4:
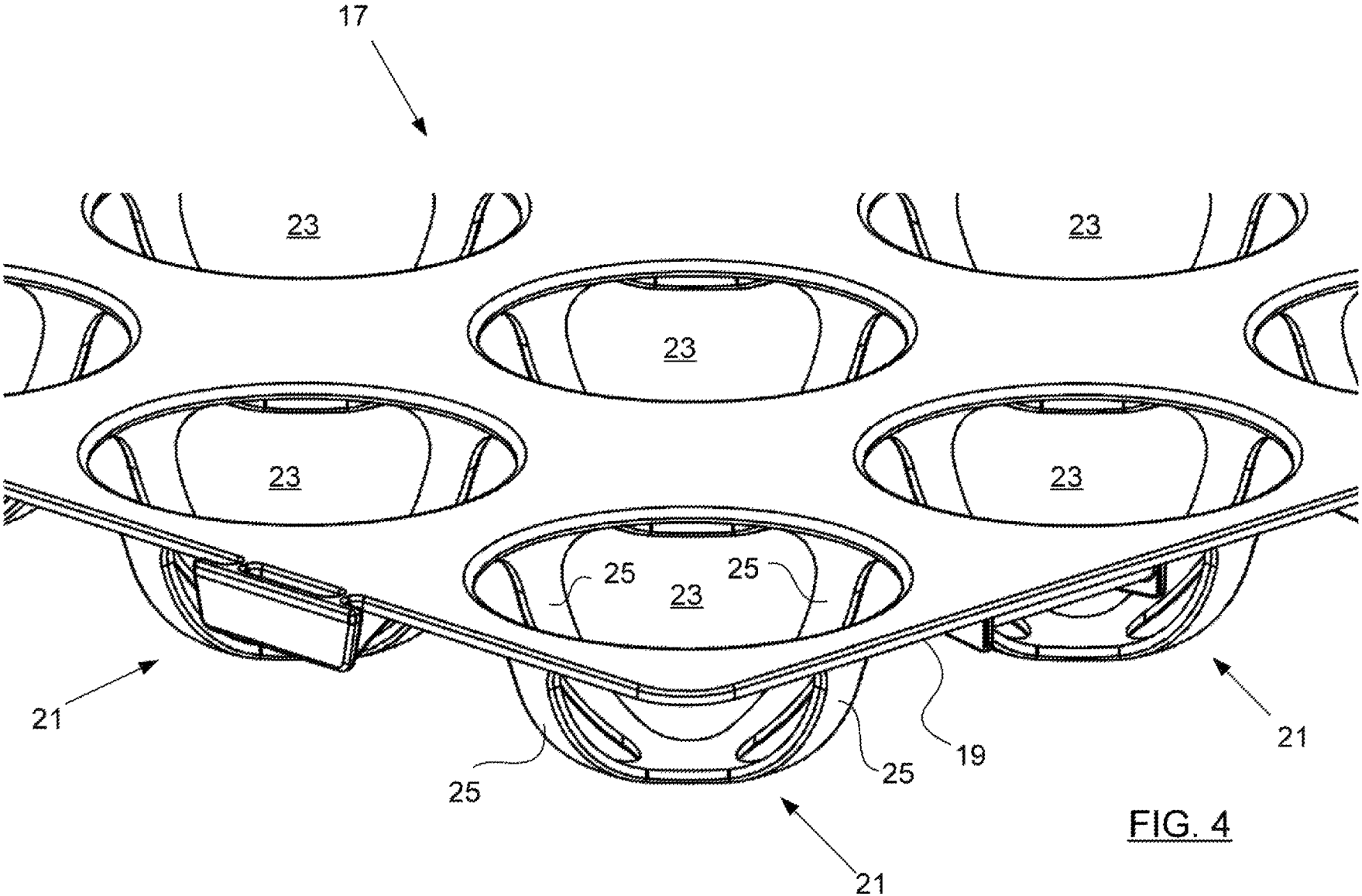
FIG. 4 is a detailed view of a portion of the shock attenuating tile of FIG. 3.

With reference to FIG. 4, each tile 17 includes a plate 19 having an upper side for bearing a load. A plurality of shock absorbing modules 21 depend from an underside of the plate 19. Each of the shock absorbing modules 21 is integrally formed with the plate 19. For example, it is preferred that the tile 17, including the plate 19 and shock absorbing modules 21 be formed of polypropylene or a similar resilient synthetic material by an injection molding process.

In the presently described embodiment each of the shock absorbing modules 21 extends from the underside of plate 19 about a corresponding aperture 23 formed through the plate 19. It will be realized that forming the plate with apertures 23 reduces the amount of material used in producing the tile without compromising the strength and resilience of the finished product.

Each of the shock absorbing modules 21 comprises a number of, in the present case four, resilient members 25. The resilient members 25 depend downward from the underside of plate 19 about the periphery of aperture 23. The remote ends of the resilient members 25 are fastened together due to them all interconnecting at their lower limits.

Figure 4A:
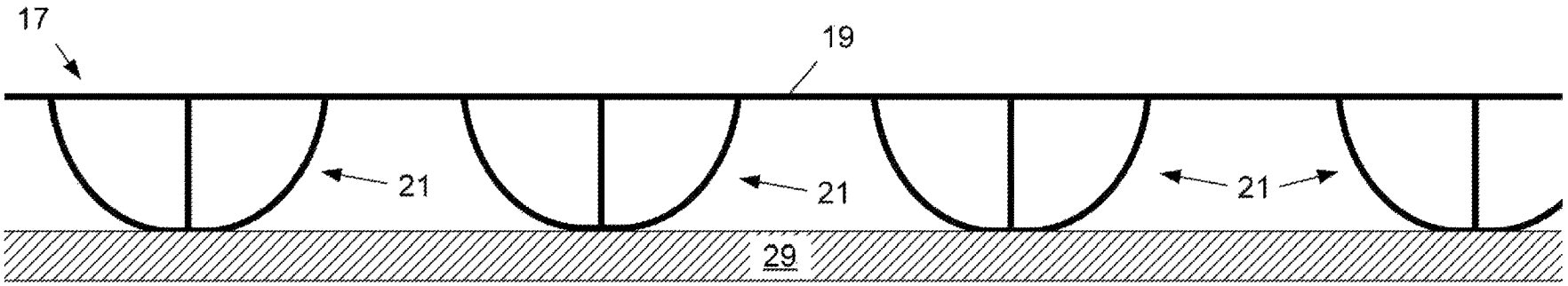
FIGS. 4A to 4C are stylized side views of the tile of the shock attenuating tile of FIG. 3 in use.
Figure 4B:
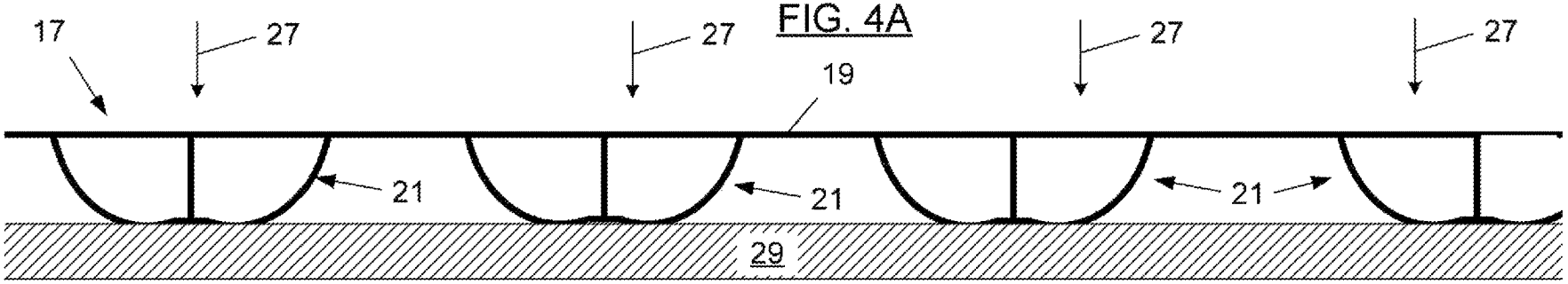
Figure 4C:
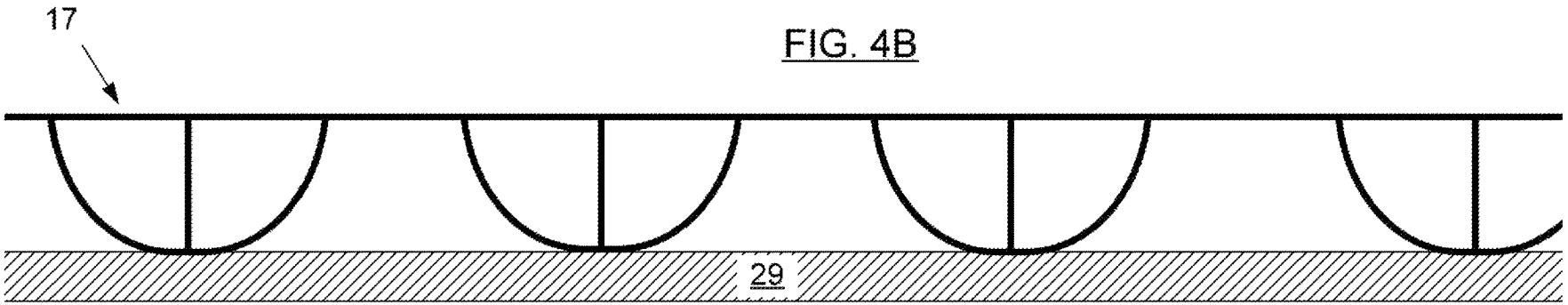

Referring now to FIG. 4A there is shown a somewhat stylistic side view of the tile 17 resting upon a floor or ground plane 29. As shown in FIG. 4B, upon a downward shock being applied to the upper side of the plate 19, as indicated by arrows 27, for example due to a child falling, the shock absorbing modules 21 non destructively deform to absorb the shock and cushion the child. Once the force 27 has been removed the shock absorbing modules 21 return to their prior shape as shown in FIG. 4C.

Figure 5:
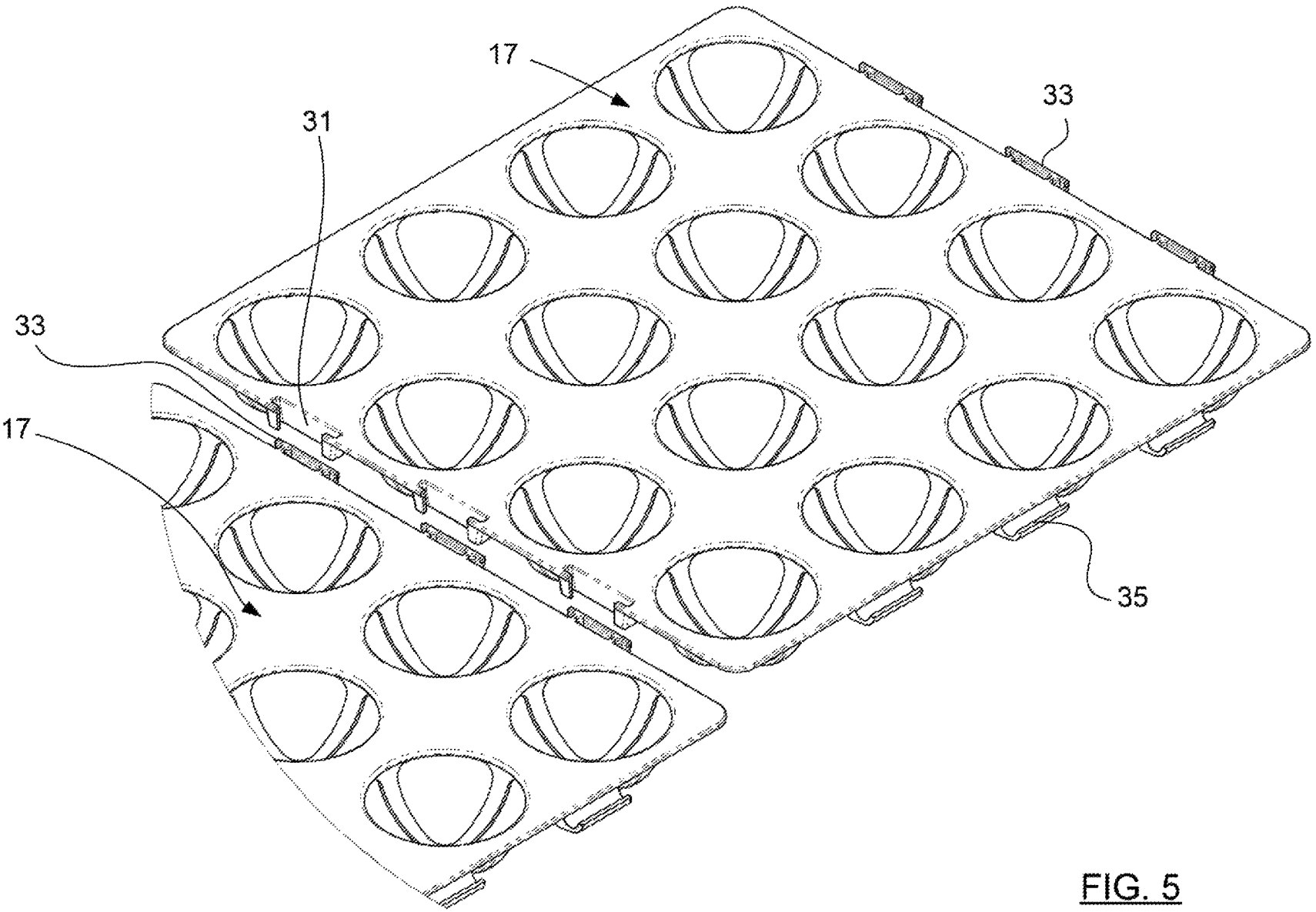
FIG. 5 is an exploded view illustrating the interlocking of tiles of FIG. 3.

Referring now to FIG. 5, engagement formations are formed along outer edges of the shock attenuating tile 17. The engagement formations include sockets 31 formed along one edge of the shock attenuating tile and complementary plugs 33 formed along another edge in order that a plurality of the tiles may be interconnected end to end.

Figure 6:
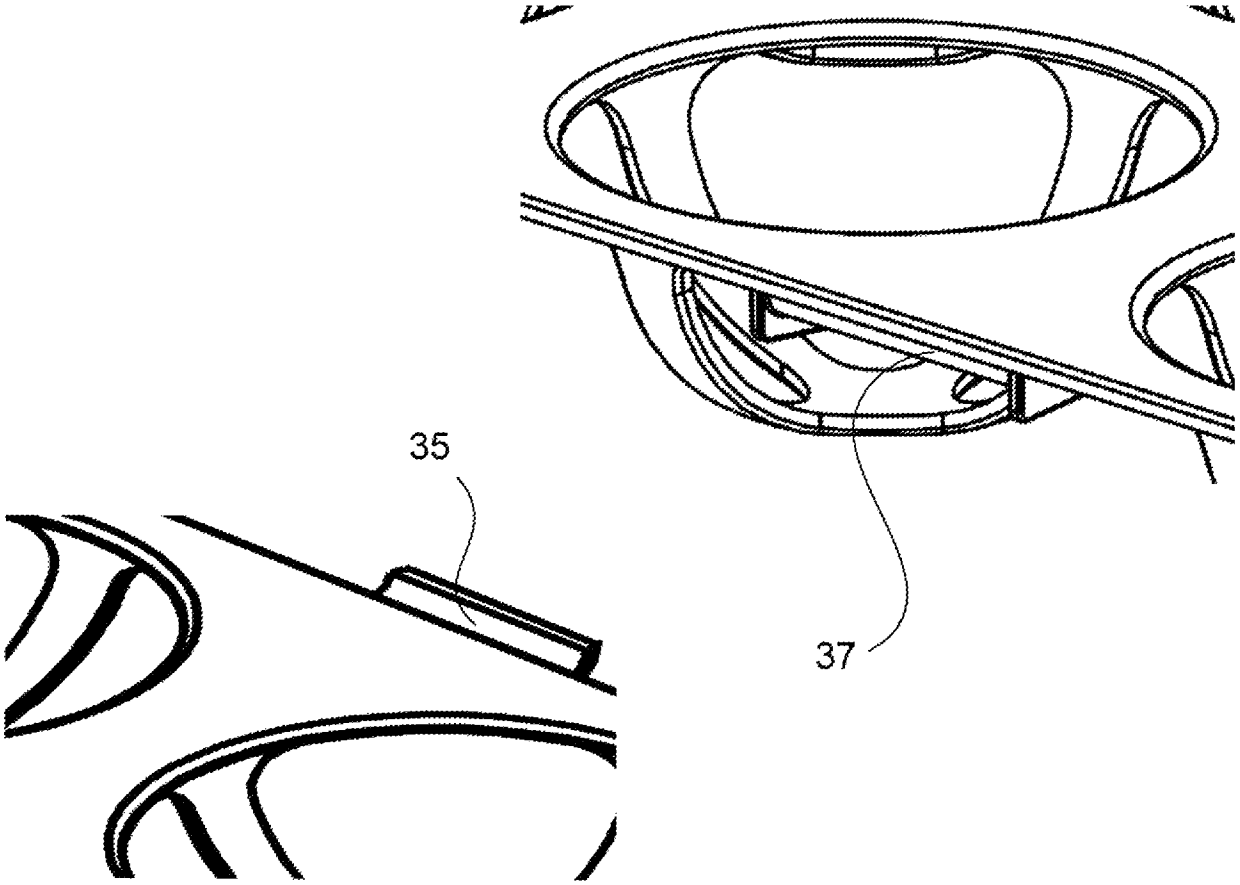
FIG. 6 depicts the complementary portions of an engagement system of the tiles of FIG. 3.

Furthermore, the engagement members also include a number of hooks 35 formed along one edge of the tile 17 and a number of complementary engagement members 37 (visible in FIG. 6) disposed along an opposite edge of the tile. If the same fastening formations were used on both sides it would be difficult to lay the tiles. The tiles are interconnected using a two part procedure. The first step is the hooking of a new tile into a tile that is already laid using the hooks 35 and engagement members 37. In step 2 the tile is then laid down and snaps into the adjacent tile next to it with the assistance of the sockets 31 and plugs 33.

Figure 7:
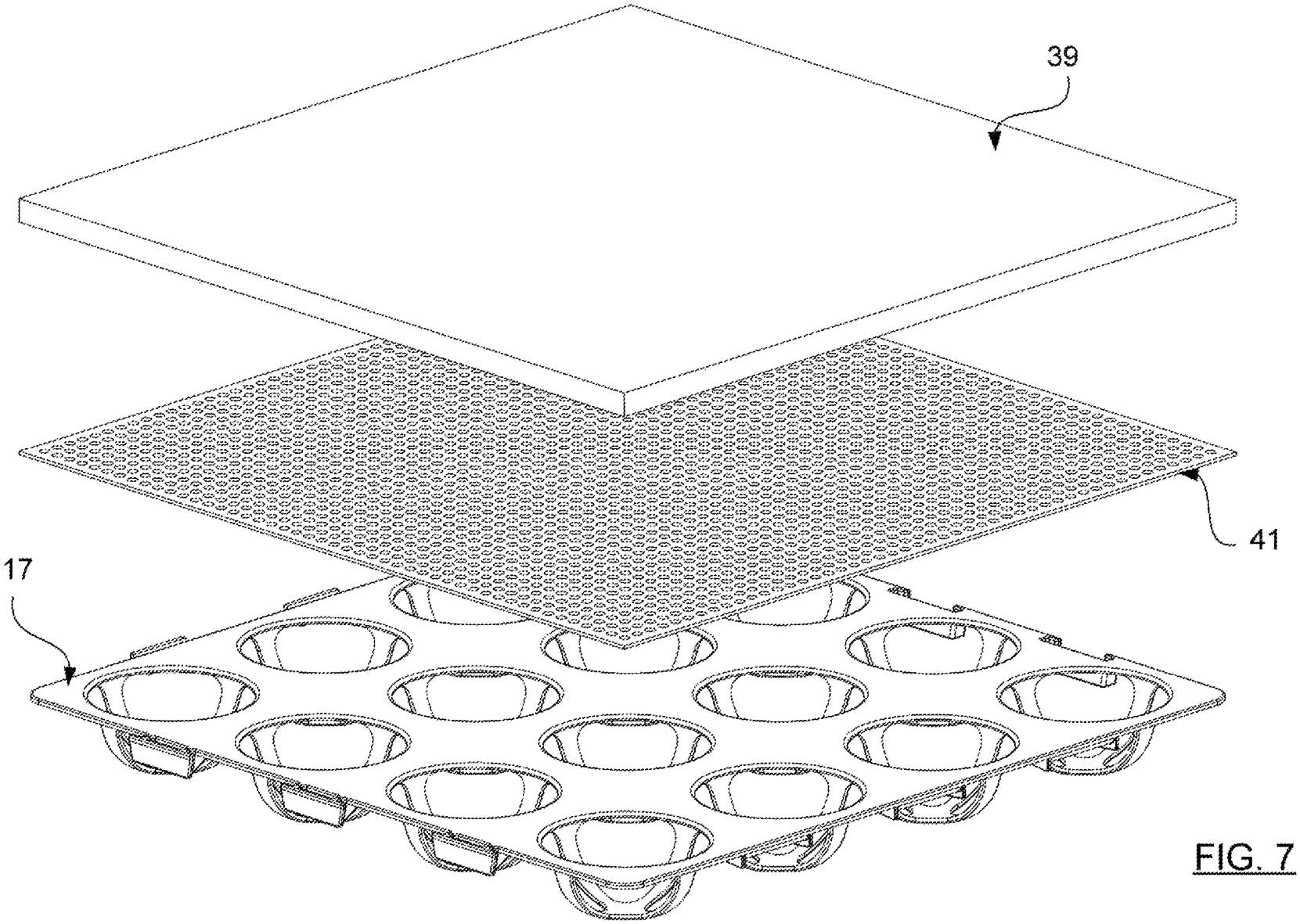
FIG. 7 is an exploded view of a shock attenuating ground covering according to a further embodiment of the present invention.

Referring now to FIG. 7, there is depicted a portion of a shock attenuating ground covering including a shock attenuating tile 17 with a cover 39 over its upper surface. A vegetation resistant mesh 41 is interposed between the shock attenuating tiles 17 and the underside of the cover to prevent the growth of grasses and weeds.

The mesh 41 may be fastened to the shock attenuating tile 17, for example by means of screw fasteners.

Figure 8:
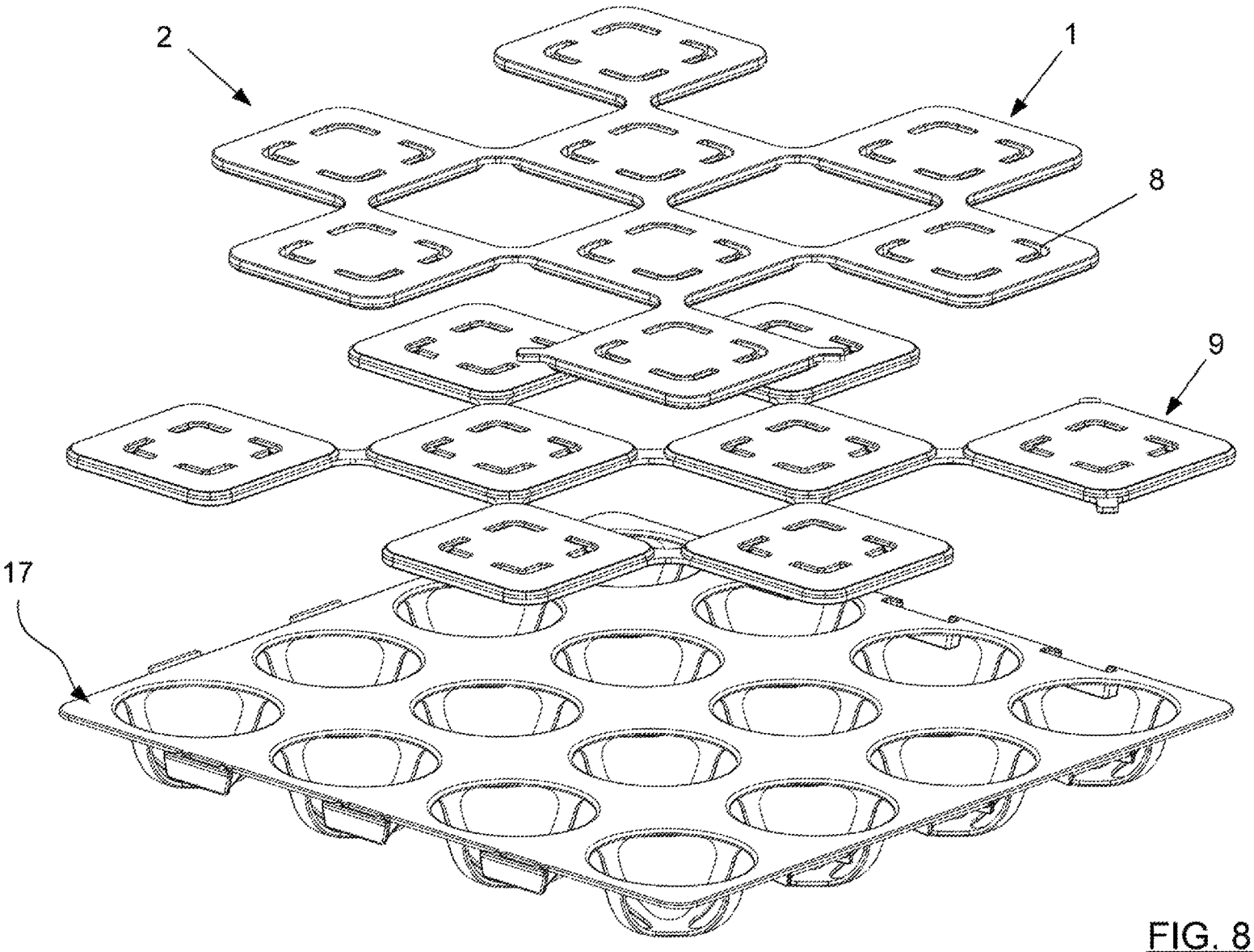
FIG. 8 is an exploded view of a portion of another shock attenuating ground covering according to another embodiment of the present invention.

As shown in exploded view in FIG. 8, in another embodiment the cover may comprise the previously described interlocking floor tile assembly 2. It is advantageous that the interlocking floor tile assembly 2 be used as the cover because it lends itself to the production of different visual patterns and has enhanced structural integrity due to the tile portions interlocking across the width and breadth of each tile assembly. The cover provides a weight bearing surface for traffic, e.g. children playing thereon, and is supported by the shock attenuating tile that is located beneath it.

The cover may be fastened to the shock attenuating tile 17 by means of screw fasteners.

The tiles of the interlocking floor tile assembly 2 may be formed with drainage apertures 8 therethrough so that water does not pool thereon.

Alternatively the cover 39 may be formed by trowelling a suitable settable compound over the mesh 41 such as an EPDM (ethylene propylene diene monomer (M-class) rubber) or a TPV (a thermoplastic vulcanizate) or a polyurethane polymer-based compound.

The shock attenuating tile may also be used as a base for other decorative finishes in a tile form manufactured as a single piece.

Figure 9:
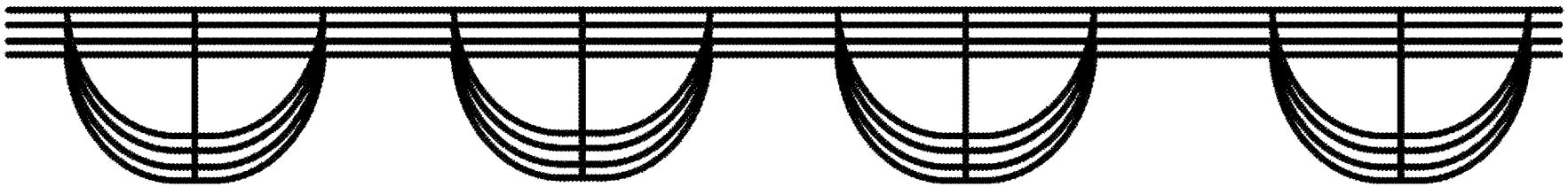
FIG. 9 is a somewhat stylized side view of a number of the shock attenuating tiles of FIG. 3 shown stacked in a nested configuration for compact shipping.

One of the benefits of the shock attenuating ground covering that has been described is that the shock attenuating tiles are formed so that they can "nest", i.e. be tightly stacked, as illustrated diagrammatically in FIG. 9. This is very advantageous because it means that sufficient tiles to cover a large surface may be compactly packed for shipping. For example, the inventor estimates that sufficient shock attenuating tiles of the type shown in FIG. 5 can be packed into a standard shipping container to cover four times the area that could be covered by a shipping container of prior art rubber tiles of similar shock absorbing characteristics.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

Any embodiment of the invention is meant to be illustrative only and is not meant to be limiting to the invention. Therefore, it should be appreciated that various other changes and modifications can be made to any embodiment described without departing from the spirit and scope of the invention.

The invention claimed is:

1. A shock attenuating ground covering including:

a plurality of interconnected shock attenuating tiles each said tile comprising a plate having an upper side for bearing a load and a plurality of shock absorbing modules integrally formed with and depending from an underside of the plate, wherein each of the shock absorbing modules comprises a plurality of resilient membranes depending downward from the underside of the plate, the plurality of resilient membranes of each shock absorbing module comprises remote ends such that respective remote ends are joined together; and a cover supported by an upper surface of the interconnected shock attenuating tiles, the cover having a first repeating array of spaced apart first tiles interconnected by first bridge portions wherein the first tiles and the first bridge portions define first spaces therebetween extending entirely through the first repeating array of the first tiles; and a second repeating array of spaced apart second tiles interconnected by second bridge portions wherein the second tiles and the second bridge portions define second spaces therebetween extending entirely through the second repeating array of the second tiles;

wherein the second tiles are received in the first spaces and the first tiles are received in the second spaces such that top and bottom surfaces of the first and second tiles form top and bottom surfaces of the cover; and wherein the first tiles and the second tiles are of the same thickness;

whereby the ground covering presents a weight bearing surface for traffic thereon and the interconnected shock attenuating tiles provide cushioning thereunder.

2. A ground covering according to claim 1, wherein the first bridge portions depend from a level flush with the top surface of the first tiles to a level between the top and bottom surface of the first tiles and wherein the second bridge portions extend upward from a level flush with the bottom surface of the second tiles to a level between the top and bottom surface of the second tiles.

3. A ground covering according to claim 1 wherein the first tiles and the second tiles bear respective complementary mating portions for mating of the first tiles with the second tiles.

4. A ground covering according to claim 3, wherein the complementary mating portions comprise complementarily chamfered or drafted edges in order that the first tiles and the second tiles snap-fit together.

5. A ground covering according to claim 1 including a vegetation resistant mesh interposed between the upper side of the shock attenuating tiles and the cover.

6. A ground covering according to claim 5 wherein the mesh is fastened to the shock attenuating tiles.

7. A ground covering according to claim 1 wherein the cover is formed of a member of the polyolefin group of materials.

8. A ground covering according to claim 1 wherein each shock attenuating tile is formed as a single piece of synthetic material.

9. A ground covering according to claim 1 wherein each of the shock absorbing members extends from the underside about a corresponding aperture formed through the plate.

10. A ground covering according to claim 1 wherein engagement formations are formed along outer edges of each of the shock attenuating tiles.

11. A ground covering according to claim 10 wherein the engagement formations include sockets formed along one edge of each of the shock attenuating tiles and complementary plugs formed along another edge of each of the shock attenuating tiles in order that the plurality of the shock attenuating tiles are interconnected.

12. A ground covering according to claim 10, wherein the engagement formations include a number of hooks formed along one edge of each of the shock attenuating tiles and a number of complementary engagement members disposed along an opposite edge of each of the shock attenuating tiles.

* * * * *